US007394204B1

(12) United States Patent
Shet et al.

(10) Patent No.: US 7,394,204 B1
(45) Date of Patent: Jul. 1, 2008

(54) ZERO CROSSING DETECTION OF LINE VOLTAGE/CURRENT OF VARIABLE AMPLITUDE

(75) Inventors: Deepak Shet, Schaumburg, IL (US); Changsheng Li, Madison, AL (US); John Jay Dernovsek, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 200 days.

(21) Appl. No.: 11/332,853

(22) Filed: Jan. 13, 2006

Related U.S. Application Data

(60) Provisional application No. 60/643,694, filed on Jan. 13, 2005.

(51) Int. Cl.
*H05B 37/02* (2006.01)

(52) U.S. Cl. ..... 315/194; 315/199; 315/DIG. 4

(58) Field of Classification Search ..... 315/194, 315/195, 196, 197, 198, 199, DIG. 4, 276
See application file for complete search history.

(56) References Cited

U.S. PATENT DOCUMENTS

| | | | | |
|---|---|---|---|---|
| 4,348,582 | A | 9/1982 | Budek | 219/483 |
| 5,821,703 | A * | 10/1998 | Callahan et al. | 315/317 |
| 6,111,368 | A * | 8/2000 | Luchaco | 315/307 |
| 6,844,810 | B2 | 1/2005 | Cern | 340/310.1 |
| 6,924,732 | B2 | 8/2005 | Yokoo | 340/310 |
| 6,933,835 | B2 | 8/2005 | Kline | 340/310.1 |
| 6,965,302 | B2 | 11/2005 | Mollenkopf et al. | 340/310 |
| 6,965,303 | B2 | 11/2005 | Mollenkopf | 340/310 |
| 6,980,091 | B2 | 12/2005 | White, II et al. | 340/310 |
| 6,987,430 | B2 | 1/2006 | Wasaki et al. | 333/124 |
| 6,987,444 | B2 | 1/2006 | Bub et al. | 340/310 |
| 6,998,962 | B2 | 2/2006 | Cope et al. | 340/310 |
| 6,999,505 | B2 | 2/2006 | Yokoo et al. | 375/222 |
| 7,023,324 | B2 | 4/2006 | Kodama et al. | 340/310 |
| 7,030,734 | B2 | 4/2006 | Butler et al. | 340/310.1 |
| 7,034,225 | B2 | 4/2006 | Thompson et al. | 174/66 |
| 7,034,663 | B2 | 4/2006 | Mansfield et al. | 340/310 |
| 7,042,351 | B2 | 5/2006 | Kline | 340/538 |

* cited by examiner

*Primary Examiner*—David H. Vu
(74) *Attorney, Agent, or Firm*—Waddey & Patterson; Mark J. Patterson

(57) ABSTRACT

A method and apparatus for detecting a zero crossing or desired phase angle of a power line signal having a variable amplitude uses a ratio between a peak amplitude of the power line signal and the amplitude of the power line signal at a desired phase angle for a known amplitude version of the power line signal to detect when a variable amplitude version of the power line signal is at the desired phase angle or zero crossing. The detection of the phase angle is used to determine if a notch is present in the power line signal. A substantially constant width pulse is generated if a notch is detected regardless of the amplitude of the power line voltage or current. The invention is particularly useful in a lighting system for generating and detecting pulses used to communicate information from a power line communication controller to a series of electronic ballasts over a power line used to power the ballasts. The information can be used to control a dimming function of the ballasts.

22 Claims, 7 Drawing Sheets

ZERO CROSSING DETECTION OF LINE VOLTAGE/CURRENT OF VARIABLE AMPLITUDE

This application is a Non-Provisional Utility application which claims benefit of co-pending U.S. Patent Application Ser. No. 60/643,694 filed Jan. 13, 2005, entitled "Zero Crossing Detection of Line Voltage/Current of Variable Amplitude" which is hereby incorporated by reference.

Be it known that we, Deepak Shet, a citizen of India, residing in Huntsville, Ala., Changsheng Li, a citizen of China, residing in Madison, Ala., and Jay Dernovsek, a citizen of the United States of America, residing in Madison, Ala., have invented a new and useful "Method and Apparatus for Zero Crossing Detection of Line Voltage/Current of Variable Amplitude."

FIELD OF THE INVENTION

The present invention relates generally to a circuit for producing substantially constant width pulses based upon notches detected in an input AC power line signal having a variable amplitude. More particularly, the invention may be used to detect notches and produce constant width pulses in a ballast communication system that uses notches in a power line signal to communicate dimming information to a series of ballasts.

BACKGROUND OF THE INVENTION

Circuits that produce a pulse based upon a notch detected in an AC power signal have been described in the prior art. For example, U.S. Pat. No. 6,580,230 teaches a dimmer circuit with a phase detector which monitors the phase angle difference between voltage and current applied to a gaseous discharge device. Changes in the phase angle between the power voltage and current are used to produce a pulse that is in turn used to transfer information to a plurality of ballasts that use the received voltages as a power supply. The circuit of the '230 patent uses a fixed reference point, such as a zero crossing, to determine a phase angle difference between the voltage and current. Using this method of data transmission, the width of a pulse created based upon the zero crossings varies dramatically with changes in the input voltage. Thus, when a pulse is created based upon the detected phase difference between the line voltage and current, the width of the pulse will vary for a low input line voltage, such as 108 V, and a high input line voltage, such as 305 V. This is important due to the fact that many modern electronic devices are designed to be used with either a 120 V or 277 V input line voltage that has a tolerance of plus or minus 10%. The primary disadvantage of using the prior art zero crossing detection circuit is that when the generated pulse width changes due to changes in the input voltage, detection of the pulses produced becomes more difficult and the output of the detection circuit is difficult to interpret. This makes the transmission and reception of data complicated and unreliable.

Therefore, what is needed is a receiver circuit for detecting data bits represented by notches in an input power voltage that generates a constant output pulse width irrespective of the input line voltage.

SUMMARY OF THE INVENTION

An embodiment of the present invention is directed toward a method of detecting a predetermined phase angle of a periodic line voltage or current having a known waveform but a variable amplitude. In accordance with the method, a ratio of a peak value of the line voltage or current to a value of the line voltage or current that corresponds to the predetermined phase angle of the line voltage or current is determined. If the voltage or current is sinusoidal, the ratio is the sine of the predetermined phase angle. A peak value of the periodic line voltage or current is then detected. A capacitor is used to detect and store the peak value of the voltage or current. The peak value of the line voltage or current is divided by the ratio to produce a reference amplitude. A resistive divider is used to divide the peak value by the ratio and produce the reference amplitude. The reference amplitude is then detected to determine when the line voltage or current is at the predetermined phase angle. A pulse is produced when the reference amplitude is detected. The pulse is preferably used to communicate information from a power line communication controller to electronic ballasts in a lighting system. This information is used to dim lights in the lighting system.

Another embodiment of the present invention is directed toward a device for detecting a predetermined phase angle of a received periodic signal having a known waveform but a variable amplitude. The device includes a peak value detector for detecting a peak value of the signal. The peak value detector may be a capacitor that stores the peak signal value of the received signal. A voltage divider divides the peak value of the signal by a ratio of the peak value of the signal for a known amplitude signal to a value of the signal for the known amplitude signal that corresponds to the predetermined phase angle to produce a reference amplitude. A resistive divider may be used to divide the signal and produce the reference amplitude. Alternatively, an average value detector that detects an average value of the received signal may be used and the average value used to calculate the reference amplitude. A reference amplitude detector detects when the periodic signal's amplitude is approximately equal to the reference amplitude. A pulse is produced when the detected signal amplitude is less than the reference amplitude. The device includes means for adding hysteresis to the detector to help with noise immunity. The pulse is used to communicate information from a power line communication controller to electronic ballasts in a lighting system.

Yet another embodiment of the present invention is directed toward an apparatus for detecting a predetermined phase angle of a periodic signal having a variable amplitude. The apparatus includes means, such as a capacitor, for detecting a recent peak amplitude of the periodic signal and means, such as a resistive divider, for dividing the recent peak amplitude of the periodic signal by a ratio of a peak amplitude of a known amplitude version of the periodic signal to an amplitude of the known amplitude version that corresponds to the predetermined phase angle of the periodic signal to produce a reference amplitude. The apparatus then has means for detecting the reference amplitude. A pulse is produced when the detected amplitude of the signal drops below the reference amplitude. The pulse is used to communicate information from a power line communication controller to an electronic ballast in a lighting system.

DESCRIPTION OF THE PREFERRED EMBODIMENTS

The idea behind the present invention is to detect predefined phase angles on a sine wave power supply signal independent of the line voltage for use as starting and ending points in generating or detecting a pulse. The peak of the sine wave shaped power signal is referred to as the peak voltage, Vp. Vx is defined as a fraction of the peak voltage of the sine wave that corresponds to a desired phase angle of the sine wave. Thus, the inverse sine of the fraction Vx/Vp gives the angles at which the start and end of the pulse is generated or detected.

$$\theta_{start}=180-\sin^{-1}(Vx/Vp)$$

$$\theta_{end}=\sin^{-1}(Vx/Vp)$$

Theoretically, $\theta_{start}$ will be between 90 and 180 degrees for the start of the pulse while $\theta_{end}$ will be between 0 and 90 degrees. The circuit can be further adapted to receive the input from a current transformer instead of a voltage. This will help to detect the zero crossing of the current and will generate a zero cross pulse that is of substantially constant width at different current levels.

An embodiment of the present invention is particularly useful in a power line communication (PLC) system for energy management of electronic ballasts, control of dimming ballasts or setting light levels for user defined light level ballasts. However, embodiments of the present invention can be utilized in any circuit where it is desirable to detect a consistent reference point on a given periodic signal. In addition, the present invention simplifies the required circuitry and, thus, allows for easy retrofit of the invention into existing installations with minimal effort. More particularly, embodiments of the present invention simplify the receiver circuits required in the dimming or controllable ballasts of a lighting system. Simplification of the receiving circuitry dramatically reduces the overall cost and complexity of such a system since most of the cost of a PLC controlled lighting system is in the ballast. This is due to the fact that multiple ballasts are controlled by a single PLC controller. The same circuit design used in the receivers may be used in the transmitter to generate the notch. The start of the pulse produced by a circuit constructed in accordance with an embodiment of the present invention can also be used to start notch generation. This is advantageous in that implementing the notch generation functionality in hardware and frees up processing power for use in other tasks.

Figure 1:
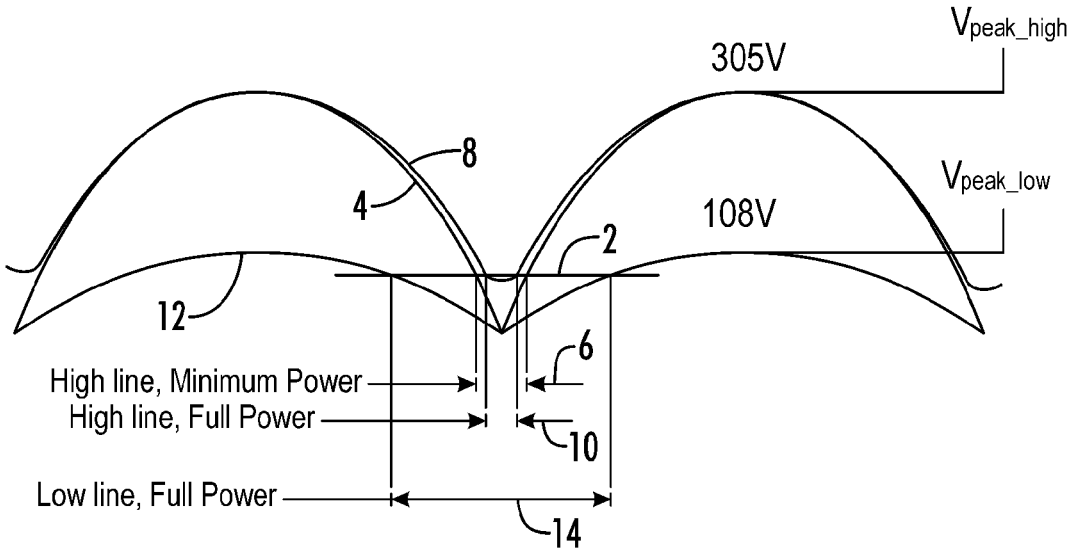
FIG. 1 (PRIOR ART)
FIG. 1 is a graph of zero crossing pulse widths generated with a prior art detection circuit for zero crossings without a notch present in the power signal.

Referring now to FIG. 1, a prior art scheme for detecting notches induced in an input power voltage signal is shown. A reference voltage level 2 is selected that represents a predetermined voltage level. Whenever the rectified high line power voltage 4 passes below the reference voltage level 2, a pulse 6 is generated that continues until the rectified high line voltage 4 rises above the reference voltage level 2. When the high line voltage 4 is delivering full power, a pulse 6 is created having a width represented by lines 6. However, if the high line voltage 8 is delivering minimum power, a slightly smaller width pulse 10 is created using the same reference voltage level 2. More importantly, if the ballast is designed to operate using different input power voltages, a low line power voltage 12 at full power produces a pulse width 14 that is substantially wider than the pulse widths 6 and 10 created when the ballast is powered by the high line power supply voltages 4 and 8. As discussed in more detail herein, the variation in the width of the zero crossing pulses 6, 10 and 14 makes the presence of a notch induced in the power line signal near the zero crossing difficult to detect.

Figure 2:
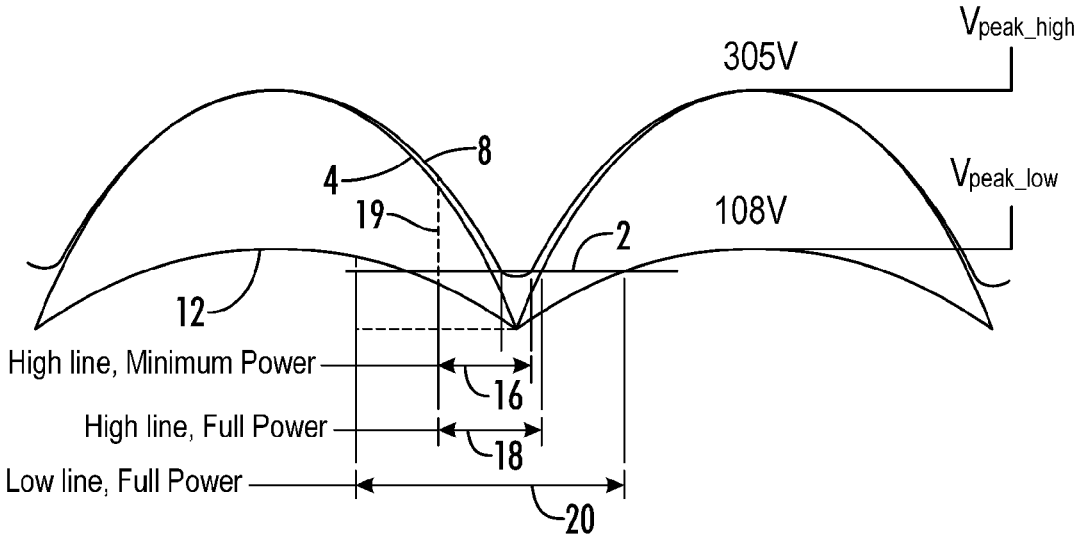
FIG. 2 (PRIOR ART)
FIG. 2 is a graph of zero crossing pulse widths generated with a prior art detection circuit for zero crossings with a notch present in the power signal.

The difficulty that results from the variation in the detected pulse width can better be understood by reference to FIG. 2. FIG. 2 is graph of the pulse widths 16, 18 and 20 produced with the high line power voltages 4 and 8 and low line power voltage 12 when a notch 19 has been induced at the zero crossing of the rectified power signal. As shown in FIG. 2, the pulse widths 16 and 18 produced with a high line power input signal 4 or 8 having a notch 19 is relatively small when compared to the low line maximum power pulse width 20. More importantly, the pulse width 14 for a low line power signal 12 without a notch, as shown in FIG. 1, is greater than the pulse width 18 for a highline power signal 4 with a notch 19, as shown in FIG. 2. Thus, the width of the zero crossing pulse can not be accurately used to determine the presence of a notch if the power line voltage varies significantly.

Figure 3:
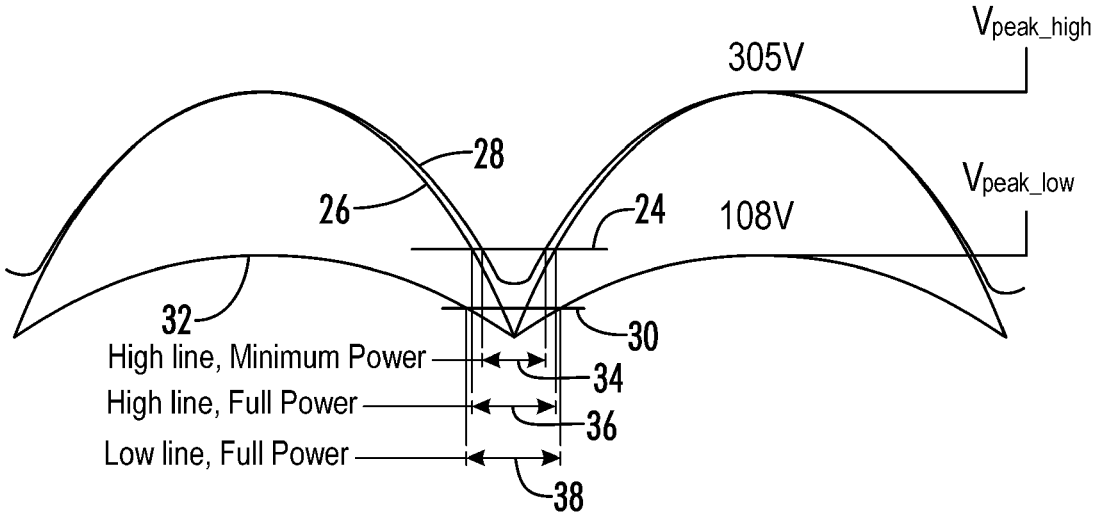
FIG. 3 is a graph of zero crossing pulse widths generated with a circuit constructed in accordance with an embodiment of the present invention without a notch present in the power signal.
Figure 4:
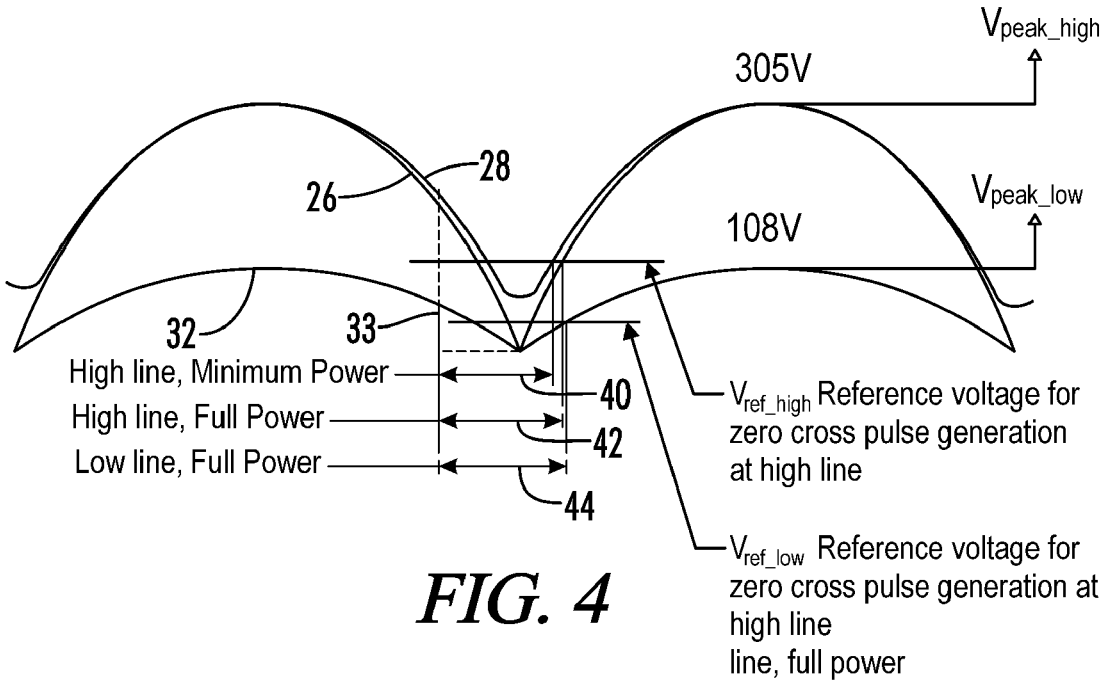
FIG. 4 is a graph of zero crossing pulse widths generated with a circuit constructed in accordance with an embodiment of the present invention with a notch present in the power signal.

Referring now to FIG. 3, a scheme for detecting notches induced in a power line signal in accordance with the present invention is shown. The present invention utilizes a first reference voltage 24 for a high line power signal 26 or 28 and a second reference voltage 30 for a low line power signal 32. As shown in FIG. 3, the pulse widths 34, 36 and 38 created using this scheme for a high line power signal 26 or 28 and a low line power signal 32 that do not have an induced notch are approximately the same width. More importantly, as shown in FIG. 4, the pulse widths 40, 42 and 44 created for the low and high line power voltages having an induced notch 33 are all approximately equal and are all greater than the pulse widths produced when a notch 33 is not present. Thus, the pulse widths created in accordance with an embodiment of the present invention can be used to accurately detect the presence of a notch without regard to whether a high line power voltage or a low line power voltage is used to power the ballast. While the graphs of FIGS. 3 and 4 use two reference voltages, embodiments of the present invention actually create a reference voltage that varies depending upon the input voltage as discussed in more detail below.

Figure 5:
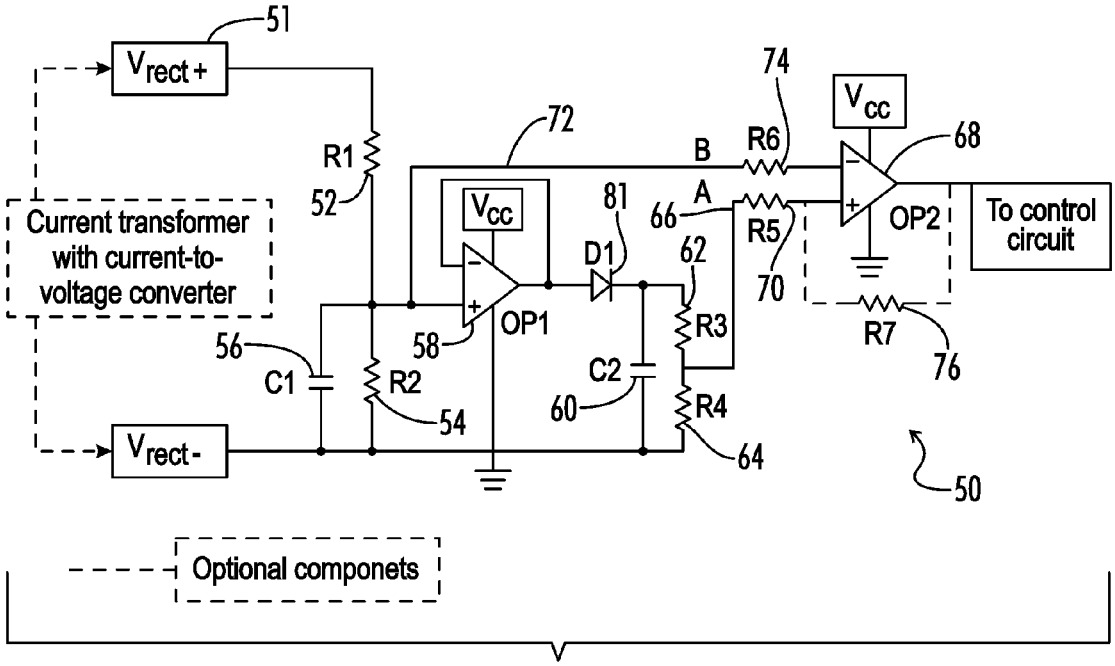
FIG. 5 is a schematic drawing of a circuit for implementing an embodiment of the present invention.

Referring now to FIG. 5, a circuit 50 for implementing a zero crossing detection scheme in accordance with an embodiment of the present invention is shown. The circuit 50 includes a resistive voltage divider that uses a first 52 and second 54 resistor to divide a rectified line voltage 51 down to a suitable level. A capacitor 56 is used to filter to the voltage signal between resistors 52 and 54. The voltage on the second resistor 54 is input into an operational amplifier 58 that is configured as a simple peak detector. The capacitor 60 has a capacitance that is selected such that the capacitor 60 charges up to the peak input signal on the operational amplifier's 58 non-inverting input. The resistors 62 and 64 are then used to divide the peak voltage down to a desired reference level. A voltage proportional to the peak voltage is obtained across capacitor 60 and the series combination of resistors 62 and 64. The voltage 66 between resistors 62 and 64 is fed to the non-inverting input of a second operational amplifier 68 through resistor 70. The divided down current rectified voltage 72 is fed to the inverting input of operational amplifier 68 through resistor 74. The output of the operational amplifier 68 is a pulse that is formed whenever the current voltage applied to the non-inverting input is less than the reference voltage provided to the inverting input. Since the reference voltage is proportional to the peak voltage, which is dynamically determined, any change in the peak input voltage will result in a corresponding change in the reference voltage.

Thus, the circuit 50 adjusts for changes in the input power voltage. The waveforms obtained by the circuit 50 of FIG. 5 are shown in FIG. 3 and FIG. 4. As can be seen in the figures, the pulse widths obtained are substantially constant for varying input voltages. The reference voltage level automatically changes from a low reference voltage at low line power to a high reference voltage at high line power. This keeps the pulse widths of the zero crossings substantially constant.

Figure 6:
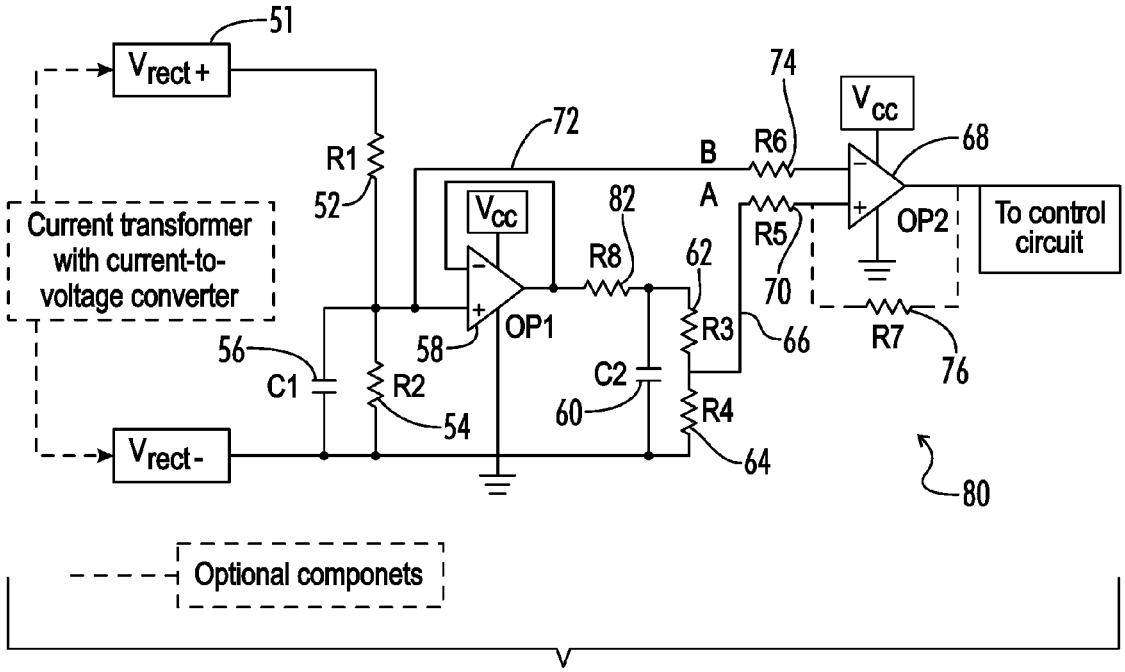
FIG. 6 is a schematic drawing of a circuit for implementing another embodiment of the present invention.

Referring now to FIG. 6 another embodiment of the present invention is shown. The circuit 80 of FIG. 6 uses an average detector to generate a first reference signal. The average value circuit is obtained by replacing the diode 81 in FIG. 5 with a resistor 82. The voltage generated on capacitor 60 is then the average value of the signal 72. Since the average value is $(2/\pi)Vp$ which is 0.636Vp. The inverse sine of 0.636 is approximately 40 degrees which is the maximum angle at which the circuit can generate a pulse.

Both the circuits of FIGS. 5 and 6 can be used to generate a pulse which is not symmetric around the zero crossing of the voltage but, rather has a phase lag. By increasing the value of capacitor 56, the generation of the start of the pulse can be delayed. Thus, it is possible to start the pulse very close to the actual zero crossing.

Figure 7:
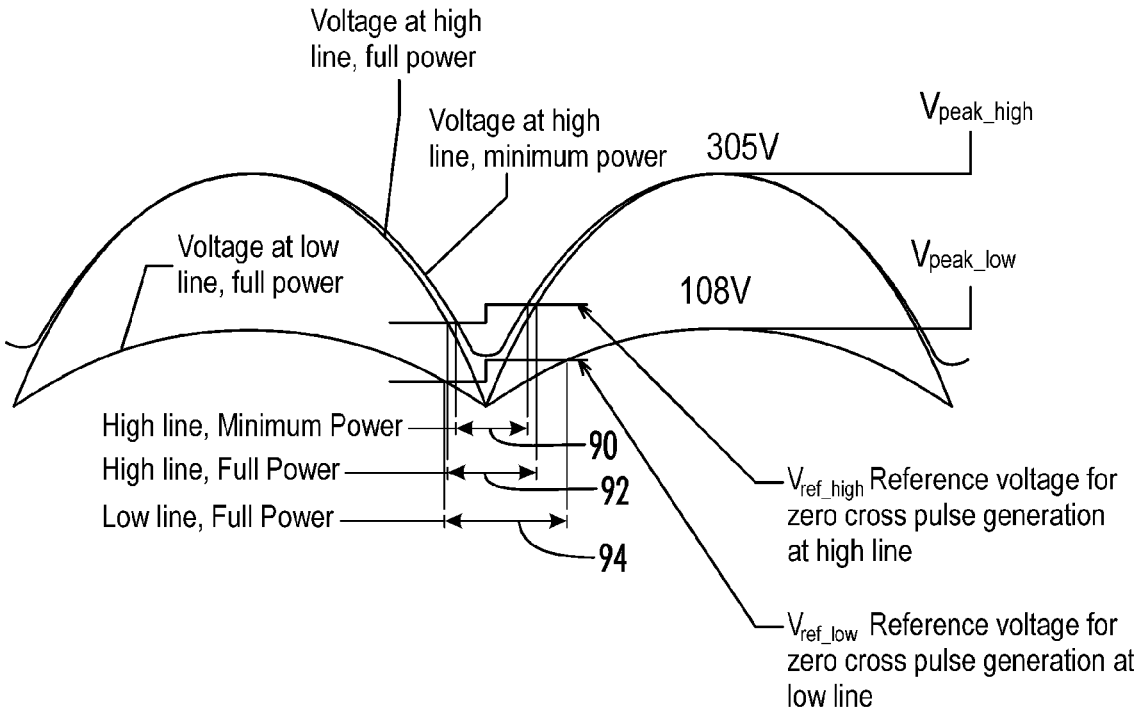
FIG. 7 is a graph of pulse widths detected by a circuit constructed in accordance with an embodiment of the present invention with an induced hysteresis in the power voltage such that an input voltage can be determined based upon the pulse width.

Resistor 76 may be used to add a little hysteresis to the signal if desired. Adding a little hysteresis with resistor 76 helps with regard to the noise immunity of the circuit. However, increasing the amount of hysteresis by decreasing the value of resistor 76 has the effect of making the pulse width vary with the line voltage. This effect can be used to sense line voltage in the transmitter or receiver as shown in FIG. 7. The trailing edge of the pulses 90, 92 and 94 depends on the line voltage. Thus, the width of the pulses can be used to determine the line voltage or current.

Thus, although there have been described particular embodiments of the present invention of a new and useful method and apparatus for Zero Crossing Detection of Line Voltage/Current of Variable Amplitude, it is not intended that such references be construed as limitations upon the scope of this invention except as set forth in the following claims.

What is claimed is:

1. A method of detecting a predetermined phase angle of a periodic line voltage or current having a known waveform but a variable amplitude, the method comprising the steps of:

determining a ratio of a peak value of the periodic line voltage or current to a value of the periodic line voltage or current that corresponds to the predetermined phase angle of the periodic line voltage or current for a known amplitude line voltage or current;

detecting a peak value of the periodic line voltage or current;

dividing the peak value of the periodic line voltage or current by the ratio to produce a reference amplitude; and detecting said reference amplitude.

2. The method of claim 1 wherein the ratio is the sine of the predetermined phase angle.

3. The method of claim 1 wherein detecting a peak value of the periodic line voltage or current further comprises using a capacitor to store the peak value of said voltage or current.

4. The method of claim 1 further comprising using a resistive divider to divide the peak value by the ratio and produce the reference amplitude.

5. The method of claim 1 further comprising producing a pulse when the detected amplitude of the periodic line voltage or current falls below the reference amplitude.

6. The method of claim 5 wherein the pulse is used to communicate information from a power line communication controller to at least one electronic ballast in a lighting system.

7. The method of claim 6 wherein the information is used to dim at least one light in the lighting system.

8. A circuit comprising:

a first voltage divider that receives a rectified AC power signal and produces an input voltage proportional to said rectified AC power signal;

a peak value detector that detects a peak amplitude value of the input voltage;

a second voltage divider that receives the peak amplitude value of the input voltage from the peak value detector and produces a reference voltage proportional to said peak amplitude value of said input voltage; and a comparator that compares an amplitude of said input voltage to an amplitude of said reference voltage and produces a substantially constant width pulse when said input voltage amplitude is greater or lower than said reference voltage amplitude.

9. The circuit of claim 8 wherein the second voltage divider produces a reference voltage that is proportional to the peak input voltage by a ratio that corresponds to the sine of a predetermined phase angle of said AC power signal at which it is desired to begin producing said pulse.

10. The circuit of claim 8 wherein the peak value detector further comprises a capacitor for storing the peak value of the input voltage and a buffer for isolating said peak value from said input voltage.

11. The circuit of claim 8 wherein the first voltage divider further comprises a resistive divider.

12. The circuit of claim 8 wherein a pulse is produced when the amplitude of the input voltage is below the amplitude of the reference voltage.

13. The circuit of claim 12 wherein the pulse is used to communicate information from a power line communication controller to at least one electronic ballast in a lighting system.

14. The circuit device of claim 12 further comprising a resistor for adding hysteresis to said comparator.

15. The circuit of claim 14 wherein a pulse width is proportional to an amplitude of said rectified AC power signal.

16. The circuit device of claim 8 wherein said peak value detector is an average value detector that detects an average value of the input voltage and the average value is used to produce the reference amplitude.

17. An apparatus for detecting a predetermined phase angle of a periodic signal having a variable amplitude, the apparatus comprising:

means for detecting a recent peak amplitude of the periodic signal;

means for dividing the recent peak amplitude of the periodic signal by a ratio of a peak amplitude of a known amplitude version of the periodic signal to an amplitude of the known amplitude version that corresponds to the predetermined phase angle of the periodic signal to produce a reference amplitude; and means for detecting said reference amplitude.

18. The apparatus of claim 17 wherein the ratio is the sine of the predetermined phase angle.

19. The apparatus of claim 17 wherein a capacitor is used to detect the recent peak value.

20. The apparatus of claim 17 wherein the means for dividing further comprise a resistive divider.

21. The apparatus of claim 17 wherein a substantially constant width pulse is produced when the detected amplitude of the signal is less than the reference amplitude.

22. The apparatus of claim 21 wherein the pulse is used to communicate information from a power line communication controller to at least one electronic ballast in a lighting system.

* * * * *